United States Patent [19]

Frey et al.

[11] 4,096,929

[45] Jun. 27, 1978

[54] MULTIPURPOSE BAG

[75] Inventors: Nancy R. Frey, Newport Beach, Calif.; Shirley Schieber, Hanalei, Hi.

[73] Assignee: ESEF Co., Newport Beach, Calif.

[21] Appl. No.: 840,551

[22] Filed: Oct. 11, 1977

[51] Int. Cl.[2] ..... A45C 3/00

[52] U.S. Cl. ..... 190/42; 5/345 R; 150/33; 150/52 G

[58] Field of Search ..... 190/1, 8, 42; 150/28 R, 150/30, 33, 35, 52 G; 5/341, 357, 345 R

[56] References Cited

U.S. PATENT DOCUMENTS

| | | | |
|---|---|---|---|
| 284,298 | 9/1883 | Havasy | 190/42 |
| 1,776,983 | 9/1930 | Rotherham | 190/42 X |
| 2,105,319 | 1/1938 | Hedden | 190/42 X |
| 2,493,506 | 1/1950 | Schwartzbard | 150/28 R |
| 2,865,433 | 12/1958 | Warner | 190/42 |
| 3,696,850 | 7/1971 | Rosenblum | 150/33 |
| 3,763,972 | 10/1973 | Karzmar | 190/8 |
| 3,938,569 | 2/1976 | Hill | 190/42 X |

*Primary Examiner*—Donald F. Norton
*Attorney, Agent, or Firm*—Gordon L. Peterson

[57] ABSTRACT

A multipurpose bag comprising first and second bag sections releasably joined along their peripheries so that a compartment is defined between the bag sections. Access to the compartment can be obtained from the top of the multipurpose bag and handles are provided to facilitate carrying of the bag. At least one of the bag sections carries a resilient pad and the other of the bag sections is openable to carry various different items.

8 Claims, 6 Drawing Figures

MULTIPURPOSE BAG

BACKGROUND OF THE INVENTION

In travelling to various spectator events, such as sporting events, it is often considered necessary or desirable to carry a large number of items for use at the event. For example, a seat cushion, a blanket, binoculars, camera, food and other items may accompany a spectator to a sporting event. The problem is, of course, how to conveniently hand carry all of these items, particularly through the large crowds often encountered at sporting events. Similar problems are encountered elsewhere, such as in boating and by participants in sports activities who must carry the clothes and implements of the sport in which they are to participate.

SUMMARY OF THE INVENTION

The present invention provides a multipurpose bag which is adapted for many uses, including those noted above. The multipurpose bag of this invention is lightweight, durable and can hold a large number of items.

To accomplish these results, the multipurpose bag preferably includes first and second bag sections with each of the bag sections including outer and inner walls interconnected to define a chamber. The first bag section has means for providing access to the chamber thereof so that items can be placed into, and removed from, the first bag section. In order to provide a cushion, resilient means is provided in the second bag section.

To increase the carrying capacity of the multipurpose bag, the first and second bag sections are joined together along a region adjacent to the peripheries of the bag sections to define a compartment between the bag sections. This compartment materially enlarges the carrying capacity of the multipurpose bag. An opening is provided to the compartment. This provides access to the interior of the compartment and permits large or long articles, such as a tennis racket, to protrude out of the compartment.

The bag sections are releasably joined together to allow the bag sections to be separated. This enables the first bag section to be used as a portable container while the second bag section is being used as a cushion.

The multipurpose bag also includes a handle coupled to at least one of the bag sections to facilitate manual grasping of the multipurpose bag. When the multipurpose bag is carried by the handle, the opening for the compartment faces upwardly so that items in the compartment will not fall out of it.

The bag sections can be releasably joined together in various differential ways. However, it is preferred to use a joining means which continuously joins the bag sections along a region. The use of continuous joining means positively precludes items from falling out of the bottom of the compartment. A zipper is the preferred releasably joining means.

The zipper can extend various distances around the bag sections depending upon the amount to which it is desired to enclose the compartment. For example, the zipper could extend for a full 360° around the bag sections to completely enclose the compartment or a lesser amount around the bag sections if completely enclosing the compartment is not required. However, for maximizing the carrying capacity of the compartment, the zipper preferably extends at least about 180° around the bag section.

The second bag section can be made resilient in various different ways. For example, the second bag section may contain a resilient pad, or it may be capable of being inflated. If a resilient pad is used, it is preferred to provide means on the second bag section for providing access to the chamber of the second bag section to permit the insertion and removal of the resilient pad.

Major portions of the multipurpose bag are preferably constructed of flexible material, such as fabric, canvas or a suitable plastic material. The outer wall of the first bag section is preferably constructed of a layer of flexible material. To improve the appearance of the exterior of the multipurpose bag, this outer wall also preferably includes a layer or panel of a material which is more rigid than the layer of flexible material. This reduces the tendency of the layer of flexible material to become folded or wrinkled in appearance.

The opening of the first bag section preferably opens upwardly. The opening can be advantageously closed by a flap extending from the outer wall to the inner wall and removably attachable to the inner wall in any suitable way, such as by Velcro.

The invention, together with further features and advantages thereof, may best be understood by reference to the following description taken in connection with the accompanying illustrative drawing.

DESCRIPTION OF THE PREFERRED EMBODIMENT

Figure 1:
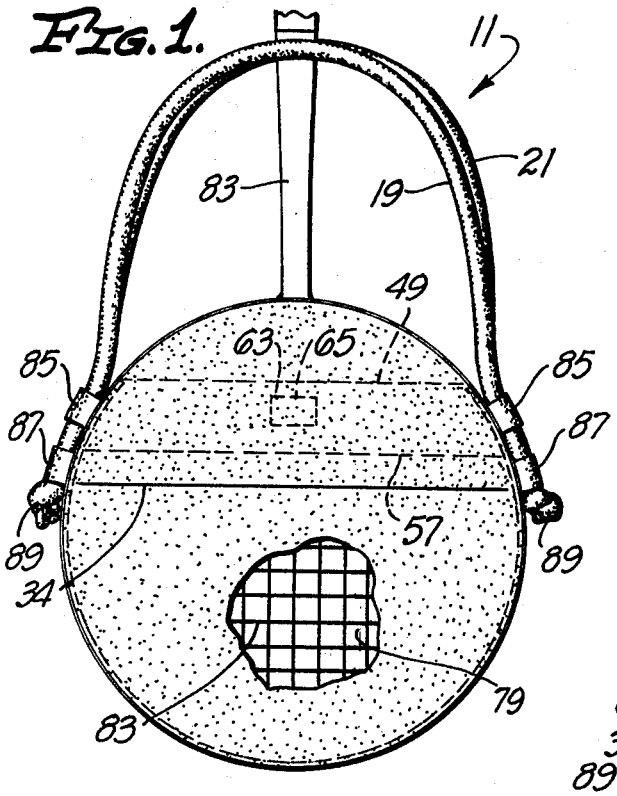
FIG. 1 is a front elevational view with parts broken away of a multipurpose bag constructed in accordance with the teachings of this invention.

The drawing illustrates a multipurpose bag 11 which includes bag sections 13 and 15, releasable joining means in the form of a zipper 17 for releasably joining the two bag sections together, and handles 19 and 21 attached to the bag sections 13 and 15, respectively. Although the bag sections 13 and 15 may be of various different configurations, in the embodiment illustrated, each of them is circular as viewed in front elevation with the diameters of the two circles being equal.

Figure 5:
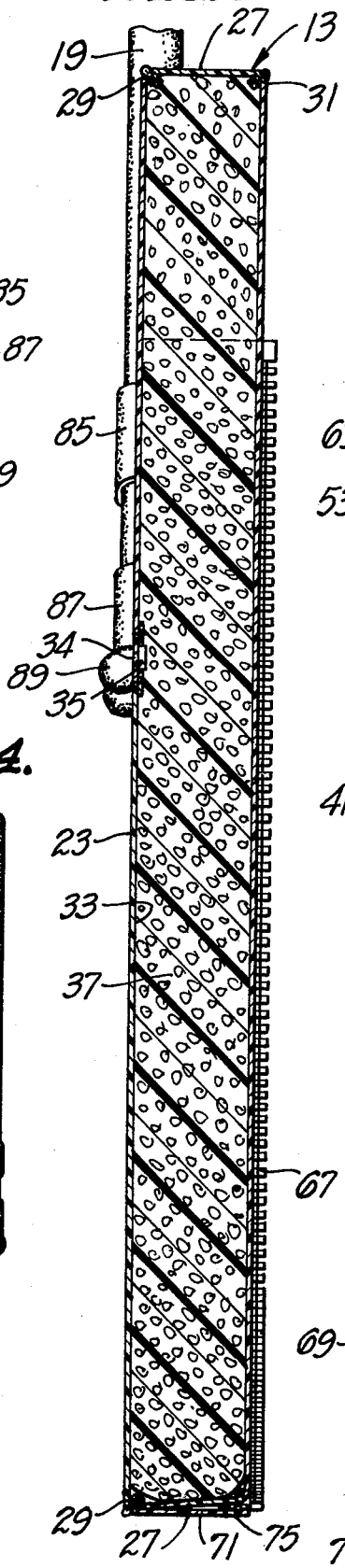
FIGS. 5 and 6 are enlarged fragmentary sectional views of the two bag sections, respectively.

The bag section 13 includes an outer wall 23 (FIG. 5), an inner wall 25 and a peripheral wall 27 suitably interconnecting the walls 23 and 25 along their peripheries in any suitable manner, such as by stitching 29 and 31, respectively. Although the walls 23, 25 and 27 may be constructed of different materials, in the embodiment illustrated, each of them is constructed of flexible polyurethane and made to resemble leather. The bag section 13 has an interior chamber 33. Preferably, access is provided to the chamber 33 by a slit 34 (FIGS. 1 and 5) in the outer wall 23 which slit is normally closed by a zipper 35 (FIG. 5) within the chamber 33.

The bag section 13 is adapted to function as a seat cushion and is preferably sized accordingly. In the embodiment illustrated, the bag section 13 is made resilient by a resilient, flexible pad 37 in the chamber 33. The resilient pad 37 may be constructed of various seat cushion type materials, including foam rubber, resilient foam plastic, etc. The resilient pad 37 can be removed from the chamber 33 through the slit 34 by unzipping the zipper 35 so that it can be cleaned or replaced.

Figure 6:
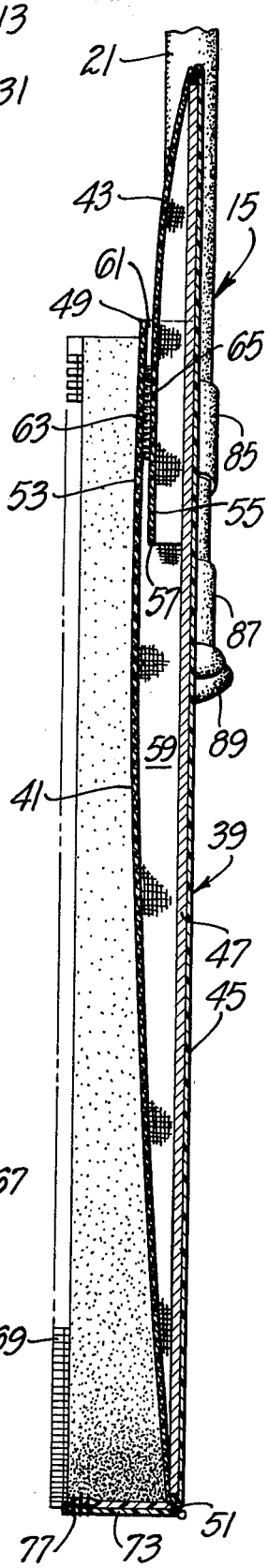

The bag section 15 includes an outer wall 39, an inner wall 41, and a flap 43 (FIG. 6). The outer wall 39 comprises an outer layer 45 of flexible material, such as simulated leather, and an inner layer or panel 47 which is substantially coextensive with the outer layer and which is stiffer than the outer layer. The inner panel 47 may be constructed of any suitable thin, relatively stiff material, such as cardboard, and it fits snuggly between the edges of the flap 43 and the inner wall 41. The outer wall 39 is circular and the inner wall 41 forms a large segment of a circle which may extend, for example, approximately 270°. Thus, the inner wall 41 has a straight upper edge 49 and a peripheral edge which is continuously permanently joined to the peripheral edge of the outer layer 45 of the outer wall 39 in any suitable manner, such as by stitching 51. The flap 43 also forms a segment of a circle and extends for somewhat over 90° so that the inner wall 41 and the flap 43 have overlapping portions 53 and 55, respectively. The flap 43 has a straight bottom edge 57. The inner wall 41 and the flap 43 are preferably constructed of a suitable waterproof fabric.

The walls 39 and 41 and the flap 43 cooperate to define a chamber 59 adapted to carry various different articles. Access to the chamber 59 is provided through an upwardly facing opening 61 between the walls 39 and 41. The opening 61 can be closed by the flap 43. If desired, the overlapping portions 53 and 55 may be suitably releasably joined together in any suitable manner, such as by Velcro strips 63 and 65 on the wall 41 and the flap 43, respectively. Thus, the overlapping portion 55 of the flap 43 can be inserted into the chamber 59, and the overlapping portions 53 and 55 can be releasably joined together by the Velco strips 63 and 65 to thereby positively close the opening 61 to the chamber 59.

The zipper 17 is of conventional construction and includes zipper portions 67 and 69 suitably attached to the peripheries of the bag sections 13 and 15, respectively. In the embodiment illustrated, the zipper portions 67 and 69 are attached to their respective bag sections 13 and 15 by peripheral walls 71 and 73, respectively, which are in turn suitably attached as by the stitching 29 and 51 to the bag sections 13 and 15. The peripheral walls 71 and 73 are preferably constructed of simulated leather and the zipper portions 67 and 69 are attached thereto as by stitching 75 and 77.

Figure 2:
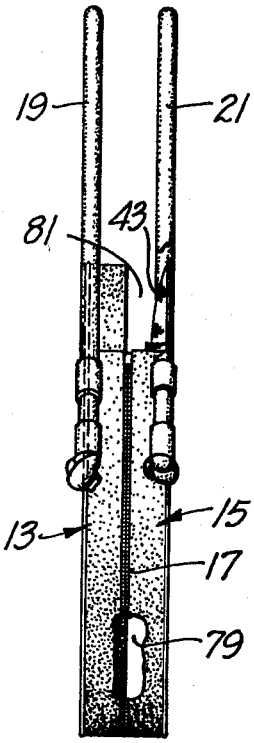
FIG. 2 is an end elevational view of the multipurpose bag with parts broken away.
Figure 3:
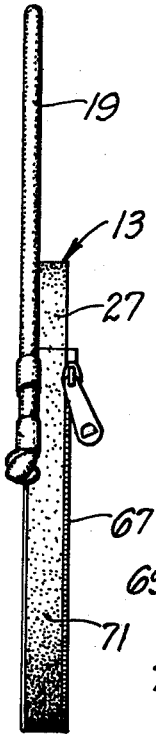
FIGS. 3 and 4 are end elevational views of the two bag sections, respectively.
Figure 4:
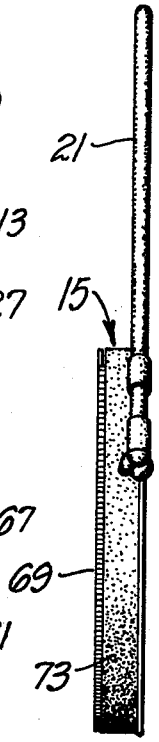

The zipper 17 can extend for various distances around the peripheries of the bag sections 13 and 15, and in the embodiment illustrated, the zipper extends along the peripheries of the bag sections for about the lower 270°. The zipper 17 permits the bag sections 13 and 15 to be joined together to form a compartment 79 (FIGS. 1 and 2). The zipper 17 also permits the bag sections 13 and 15 to be completely separated as shown in FIGS. 3–6. This enables the bag section 13 to be used as a cushion and the bag section 15 to be independently used as a container.

Because the zipper 17 does not extend completely around the periphery of the bag sections 13 and 15, an opening 81 (FIG. 2) is provided at the top of the compartment 79 for providing access to the compartment. This enables a long article, such as a tennis racket 83, to be carried by the compartment 79 and to project out of the compartment through the opening 81 as shown in FIG. 1.

The handles 19 and 21 can be attached in various different ways to the bag sections 13 and 15. However, it is important that the opening 81 face upwardly when the multipurpose bag 11 is carried by the handles 19 and 21. If this were not so, the tennis racket 83 would fall out of the compartment 79 and the use of the compartment 79 would be limited to articles which could be contained completely within this compartment, and it would be necessary for the zipper 17 to completely enclose the compartment 79.

In the embodiment illustrated, each of the handles 19 and 21 is in the form of an elongated, flexible strap attached to the associated bag section by spaced loops 85 and 87. The opposite ends of the handles 19 and 21 pass through the pairs of spaced loops 85 and 87, and knots 89 at the opposite ends of the handles prevent withdrawal of the handles from the loops. The loops 85 and 87 may, in turn, be appropriately attached to the bag sections 13 and 15 as by stitching.

The multipurpose bag 11 is very versatile, and it is capable of carrying many different articles. The zipper 17 permits the bag sections 13 and 15 to be completely separated so that the bag section 13 can be used for a cushion while the bag section 15 is being used as a portable container separate from the cushion. With the bag sections 13 and 15 joined together by the zipper 17, an intermediate compartment 79 is provided. By leaving an opening 81 at the upper end of the compartment, articles which are larger than the compartment can be carried by it by permitting such articles to project through the opening 81. Of course, the opening 81 may be formed by leaving the zipper 17 partially unzipped if the zipper extends for the full 360° around the bag sections 13 and 15. The zipper 35 permits removal of the resilient pad 37 so that the bag section 13 can also be used for the carrying of articles, if desired. The bag section 15 may contain a resilient pad if desired so that the bag section 15 can also be used as a cushion.

Although an exemplary embodiment of the invention has been shown and described, many changes, modifications and substitutions may be made by one having ordinary skill in the art without necessarily departing from the spirit and scope of this invention.

We claim:

1. A multipurpose bag comprising:

first and second bag sections, each of said bag sections including outer and inner walls and means for interconnecting said walls to define a chamber, each of said bag sections having a peripheral edge;

said first bag section having means for providing access to the chamber thereof whereby items can be carried in said first bag section;

resilient means in said second bag section whereby said second bag section is adapted to serve as a cushion;

means for releasably joining said bag sections along a region adjacent the peripheries of said bag sections with the inner walls of the bag sections confronting each other whereby a compartment is defined between said bag sections;

means for providing an opening to said compartment through which access to said compartment can be obtained;

handle means coupled to at least one of said bag sections to facilitate manual grasping of the multipurpose bag, said opening to said compartment facing generally upwardly when the multipurpose bag is carried by said handle means; and said joining means being releasable to allow said bag sections to be separated whereby said first bag section can be used as a container while said second bag section is being used as a cushion.

2. A multipurpose bag as defined in claim 1 wherein said joining means includes a zipper for continuously joining said bag sections together along said region and at least portions of at least one wall of each of said bag sections is constructed of a flexible material.

3. A multipurpose bag as defined in claim 1 wherein said joining means continuously joins said bag sections together along said region for at least about 180°.

4. A multipurpose bag as defined in claim 1 wherein said outer wall of said first bag section comprises an outer flexible layer and a panel inwardly of said outer flexible layer, said panel being constructed of stiffer material than said outer flexible layer whereby the outer flexible layer is provided with a smoother less wrinkled appearance.

5. A multipurpose bag as defined in claim 1 wherein said resilient means includes a resilient pad within said second bag section, said second bag section having means for providing access to the interior thereof to permit insertion and removal of said resilient pad from said chamber of said second bag section.

6. A multipurpose bag as defined in claim 1 wherein said outer and inner walls of said first bag section are separated from each other for a distance to define an opening to said first bag section which faces generally upwardly when said multipurpose bag is carried by said handle means and a closure flap adapted to extend between said outer and inner walls of said first bag section to close the opening in said first bag section, said flap being openable to provide access to the interior of said first bag section.

7. A multipurpose bag as defined in claim 1 wherein said joining means includes a zipper extending for at least 180° along said region and at least portions of at least one wall of each of said bag sections are constructed of flexible material, said resilient means includes a resilient pad in said chamber of said second bag section, said second bag section having means for providing access to the chamber thereof to permit removal of said resilient pad.

8. A multipurpose bag as defined in claim 1 wherein said outer wall of said first bag section comprises an outer flexible layer and a panel inwardly of said outer flexible layer, said panel being constructed of stiffer material than said outer flexible layer whereby the outer flexible layer is provided with a smoother less wrinkled appearance, and said outer and inner walls of said first bag section are separated from each other for a distance to define an opening to said first bag section which faces generally upwardly when said multipurpose bag is carried by said handle means and a closure flap adapted to extend between said outer and inner walls of said first bag section to close the opening in said first bag section, said flap being openable to provide access to the interior of said first bag section.

* * * * *